US005166459A

United States Patent [19]

Stahle

[11] Patent Number: 5,166,459

[45] Date of Patent: Nov. 24, 1992

[54] PISTOL GRIP APPARATUS

[76] Inventor: Raymond L. Stahle, R.D. #2, Box 7, Troy, Pa. 16947

[21] Appl. No.: 808,470

[22] Filed: Dec. 16, 1991

[51] Int. Cl.[5] ..... F41C 23/10

[52] U.S. Cl. ..... 42/71.02; 42/103

[58] Field of Search ..... 42/71.02, 73, 72, 71.01, 42/103

[56] References Cited

U.S. PATENT DOCUMENTS

| | | | |
|---|---|---|---|
| 552,334 | 12/1895 | Sanger | 42/71.02 |
| 628,356 | 7/1899 | Renwick | 42/71.02 |
| 2,320,450 | 6/1943 | Valenzuela | 42/71.01 |
| 2,903,810 | 9/1959 | Lewis | 42/71.02 |
| 4,758,933 | 7/1988 | Winberg et al. | 42/71.02 |
| 4,856,218 | 8/1989 | Reynold, Jr. | 42/103 |

FOREIGN PATENT DOCUMENTS

| | | | |
|---|---|---|---|
| 22288 | of 1907 | United Kingdom | 42/73 |

*Primary Examiner*—Stephen M. Johnson
*Attorney, Agent, or Firm*—Leon Gilden

[57] ABSTRACT

A guide plate is arranged for securement to a side wall of a pistol handle extending along the pistol frame and to the pistol barrel, wherein the guide plate includes an elongate groove to receive a forefinger of an individual to enhance guidance and sighting of a pistol in use.

5 Claims, 4 Drawing Sheets

17
29
28
32
33
37
9
30
24
20
22
18
A
8
31
27

PISTOL GRIP APPARATUS

BACKGROUND OF THE INVENTION

1. Field of the Invention

The field of the invention relates to pistol apparatus, and more particularly pertains to a new and improved pistol grip apparatus wherein the same is arranged to enhance sighting and operating of a pistol firearm.

2. Description of the Prior Art

Various pistol handle and guide structure is utilized in the prior art to enhance the grasping and manipulation of a pistol. Such apparatus is exemplified in U.S. Pat. No. 4,878,304 to Cupp wherein a gun grip is arranged of construction to enhance ease of securement of the associated pistol.

U.S. Pat. No. 4,630,387 to Crane, et al. wherein an adjustable pistol grip is arranged for adjustable accommodation of a pistol.

U.S. Pat. No. 4,735,008 to Williams sets forth a pistol grip with a wing member mounted relative to the pistol grip to permit two-hand hold of a pistol member.

As such, it may be appreciated that there continues to be a need for a new and improved pistol grip apparatus as set forth by the instant invention which addresses both the problems of ease of use as well as effectiveness in construction in premitting the stable and aligned orientation of a pistol relative to a target.

SUMMARY OF THE INVENTION

In view of the foregoing disadvantages inherent in the known types of pistol grip apparatus now present in the prior art, the present invention provides a pistol grip apparatus wherein the same is utilized for mounting in adjacency relative to a pistol with reception and orientation of a forefinger to enhance alignment of the pistol relative to a target. As such, the general purpose of the present invention, which will be described subsequently in greater detail, is to provide a new and improved pistol grip apparatus which has all the advantages of the prior art pistol grip apparatus and none of the disadvantages.

To attain this, the present invention provides a guide plate arranged for securement to a side wall of a pistol handle extending along the pistol frame and to the pistol barrel, wherein the guide plate includes an elongate groove to receive a forefinger of an individual to enhance guidance and sighting of a pistol in use.

My invention resides not in any of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pistol grip apparatus which has all the advantages of the prior art pistol grip apparatus and none of the disadvantages.

It is another object of the present invention to provide a new and improved pistol grip apparatus which may be easily and efficiently manufactured and marketed.

It is a further object of the present invention to provide a new and improved pistol grip apparatus which is of a durable and reliable construction.

An even further object of the present invention is to provide a new and improved pistol grip apparatus which is susceptible of a low cost of manufacture with regard to both materials and labor, and which accordingly is then susceptible of low prices of sale to the consuming public, thereby making such pistol grip apparatus economically available to the buying public.

Still yet another object of the present invention is to provide a new and improved pistol grip apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawing and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
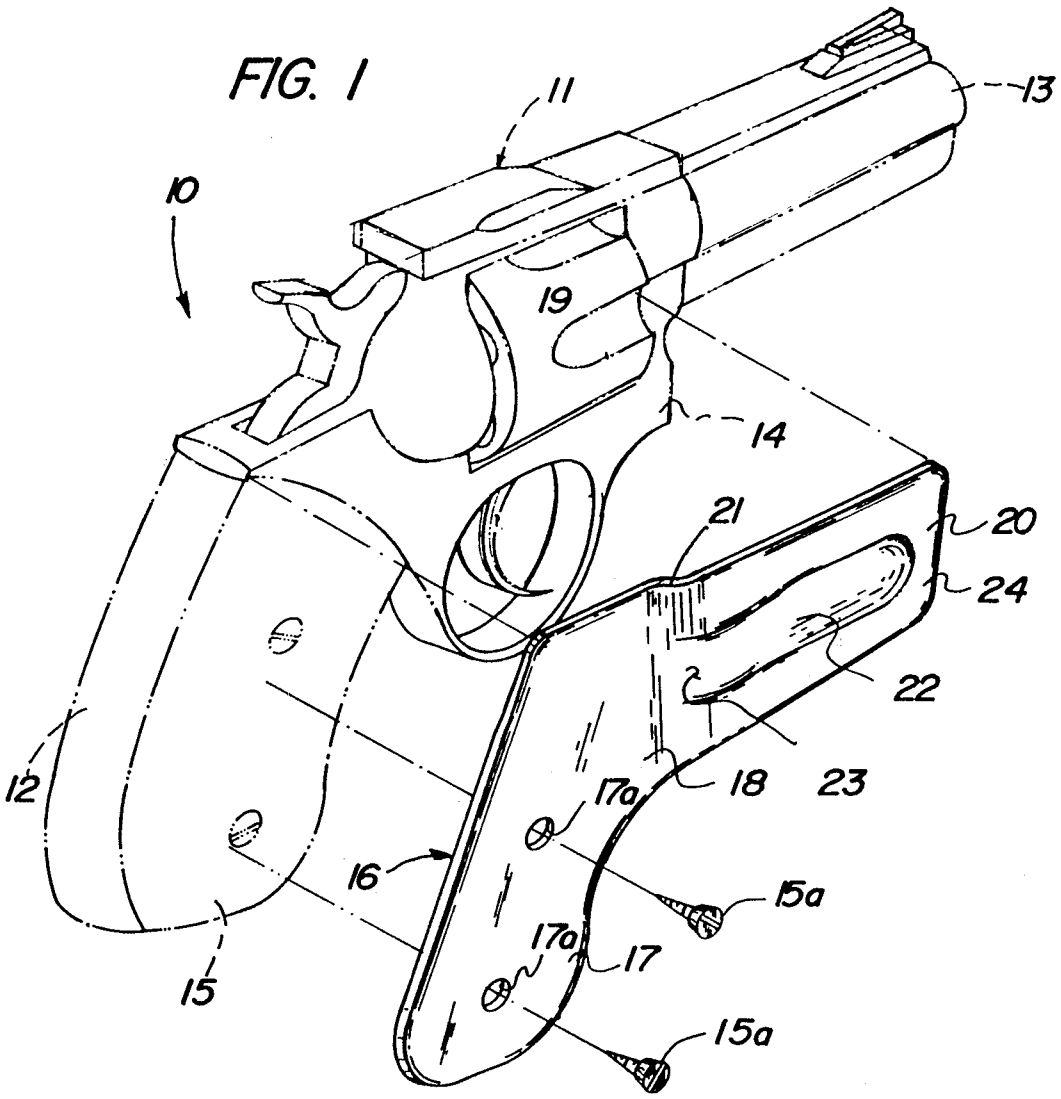
FIG. 1 is an isometric illustration of the instant invention.

With reference now to the drawings, and in particular to FIGS. 1 to 10 thereof, a new and improved pistol grip apparatus embodying the principles and concepts of the present invention and generally designated by the reference numeral 10 will be described.

Figure 2:
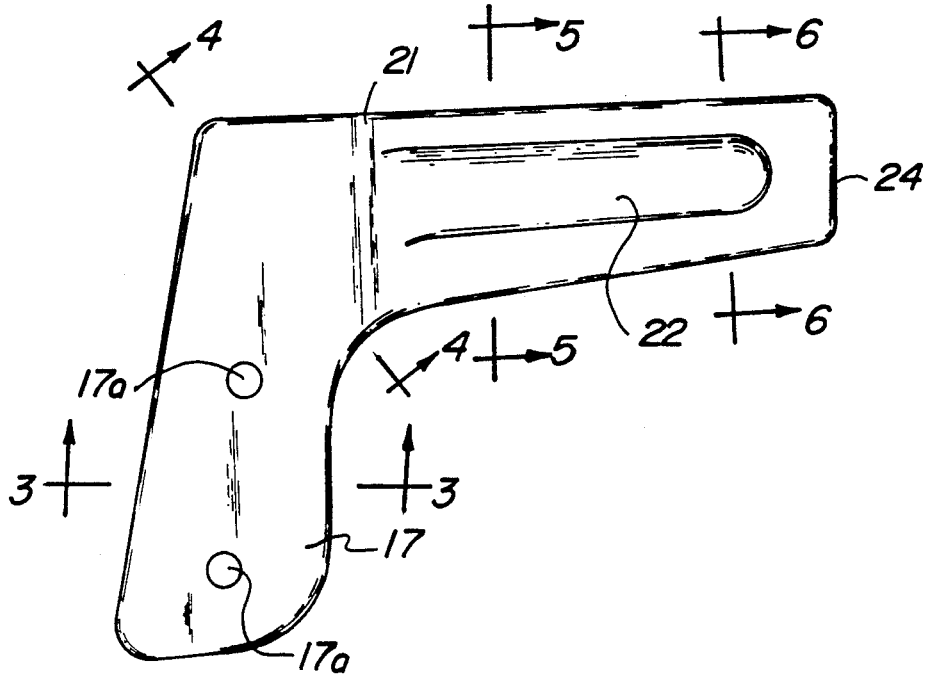
FIG. 2 is an orthographic side view of the instant invention.
Figure 5:
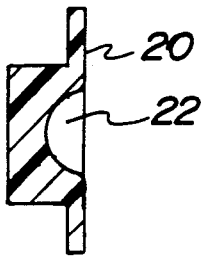
FIG. 5 is an orthographic view, taken along the lines 5—5 of FIG. 2 in the direction indicated by the arrows.
Figure 3:
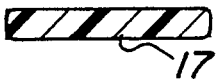
FIG. 3 is an orthographic view, taken along the lines 3—3 of FIG. 2 in the direction indicated by the arrows.
Figure 4:
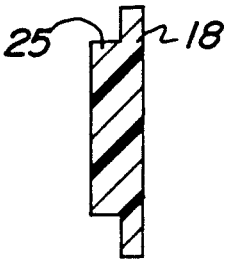
FIG. 4 is an orthographic view, taken along the lines 4—4 of FIG. 2 in the direction indicated by the arrows.
Figure 6:
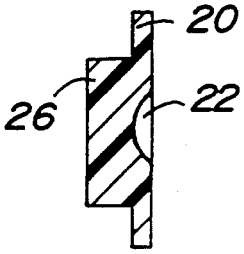
FIG. 6 is an orthographic view, taken along the lines 6—6 of FIG. 2 in the direction indicated by the arrows.
Figures 7, 8, 9:
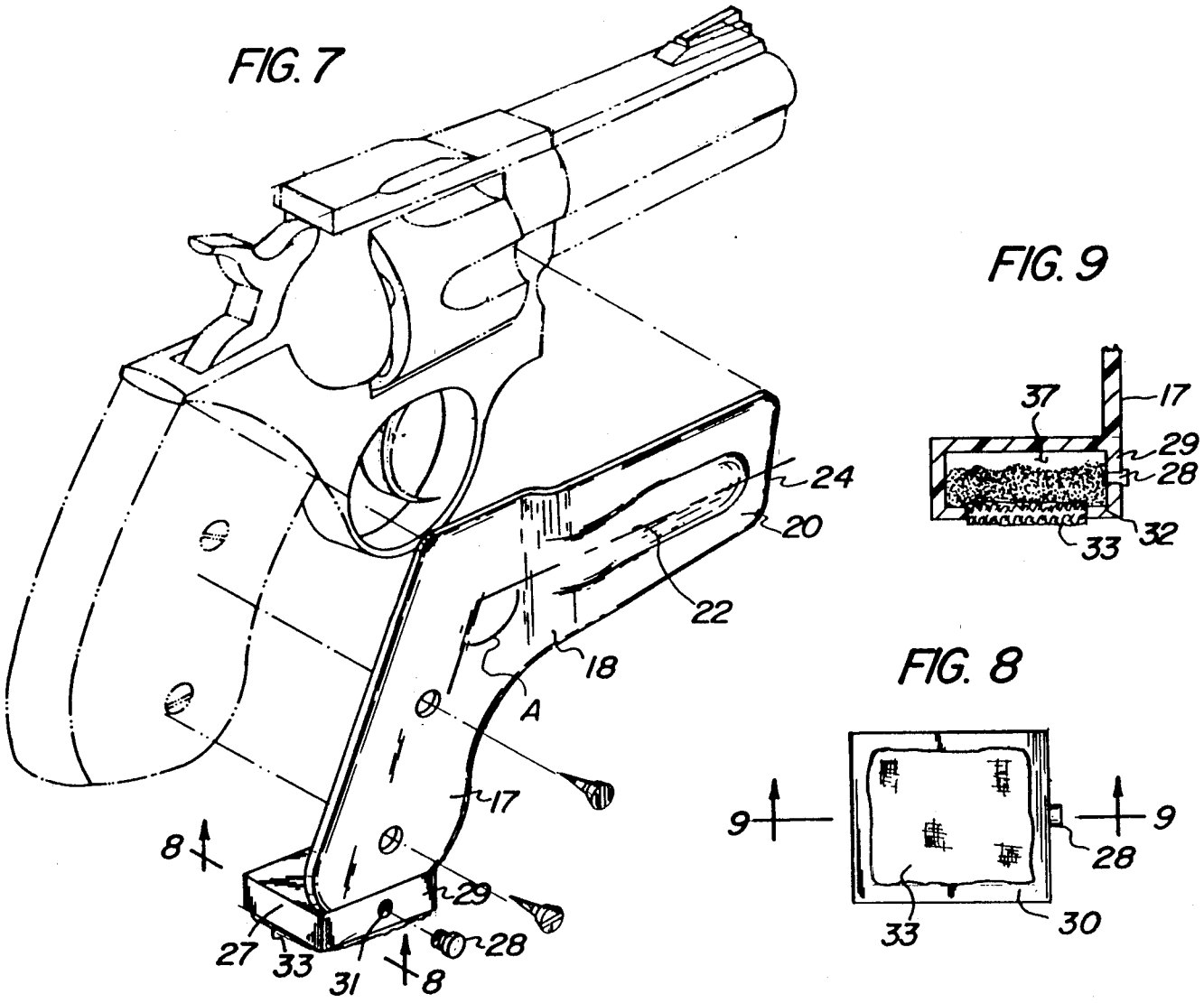
FIG. 7 is an isometric illustration of a modification of the invention.
FIG. 8 is an orthographic view, taken along the lines 8—8 of FIG. 7 in the direction indicated by the arrows.
FIG. 9 is an orthographic view, taken along the lines 9—9 of FIG. 8 in the direction indicated by the arrows.

More specifically, the pistol grip apparatus 10 of the instant invention essentially comprises a pistol assembly 11 formed to include a pistol handle 12 mounted to a pistol frame 14, with a pistol barrel 13 extending forwardly of the pistol frame, with the pistol frame further including a pistol cylinder assembly 19, as illustrated. A guide plate 16 is arranged for mounting to the pistol handle 12 to a handle side wall 15 thereof. The handle side wall includes handle side wall screw members 15*a* that in turn are directed through the guide plate, and more specifically to a first flange 17 of the guide plate through first flange bores 17*a*. The handle side wall 15 is further defined by a predetermined configuration, wherein the first flange 17 is defined by an equal predetermined configuration complementarily positioned to overlie in a contiguous and complementary manner the handle side wall 15. A first flange extension plate 18 extending forwardly of the first flange extends beyond the handle side wall 15 and over the pistol frame 14 rearwardly of the pistol cylinder assembly 19. A connecting web 21 is canted forwardly and above the first flange extension 18, with a second flange 20 mounted to the connecting web 21 at an upright end of the connecting web, with a lower end of the connecting web mounted to the first flange extension 18. The second flange 20 includes a second flange groove 22 oriented longitudinally and medially of the second flange, with a second flange groove entrance 23 directed through the connecting web 21, and the groove terminating rearwardly of a second flange forward terminal end 24. The second flange 20, the connecting 21, and the first flange extension 18 are each longitudinally aligned relative to one another and define an obtuse included angle 4 relative to the first flange 17, in a manner such as illustrated in FIG. 2.

A modified aspect of the invention includes a reservoir container 27 mounted to a lower distal end of the first flange 17, with a reservoir container side wall 29 coplanar with the first flange 17, and a container plug 28 directed through the container side wall 29 for reception within a fill bore 31 to permit the filling of a housing cavity 37, with a chalk powder 32. The chalk powder permits an indivdual to direct such chalk powder onto a shooter's hand to provide for a non-slip grasping of the pistol during use and to absorb such moisture, wherein the chalk powder 32 is dispensed through a fibrous dispensing mesh 33 directed through the reservoir container bottom wall 30.

Figure 10:
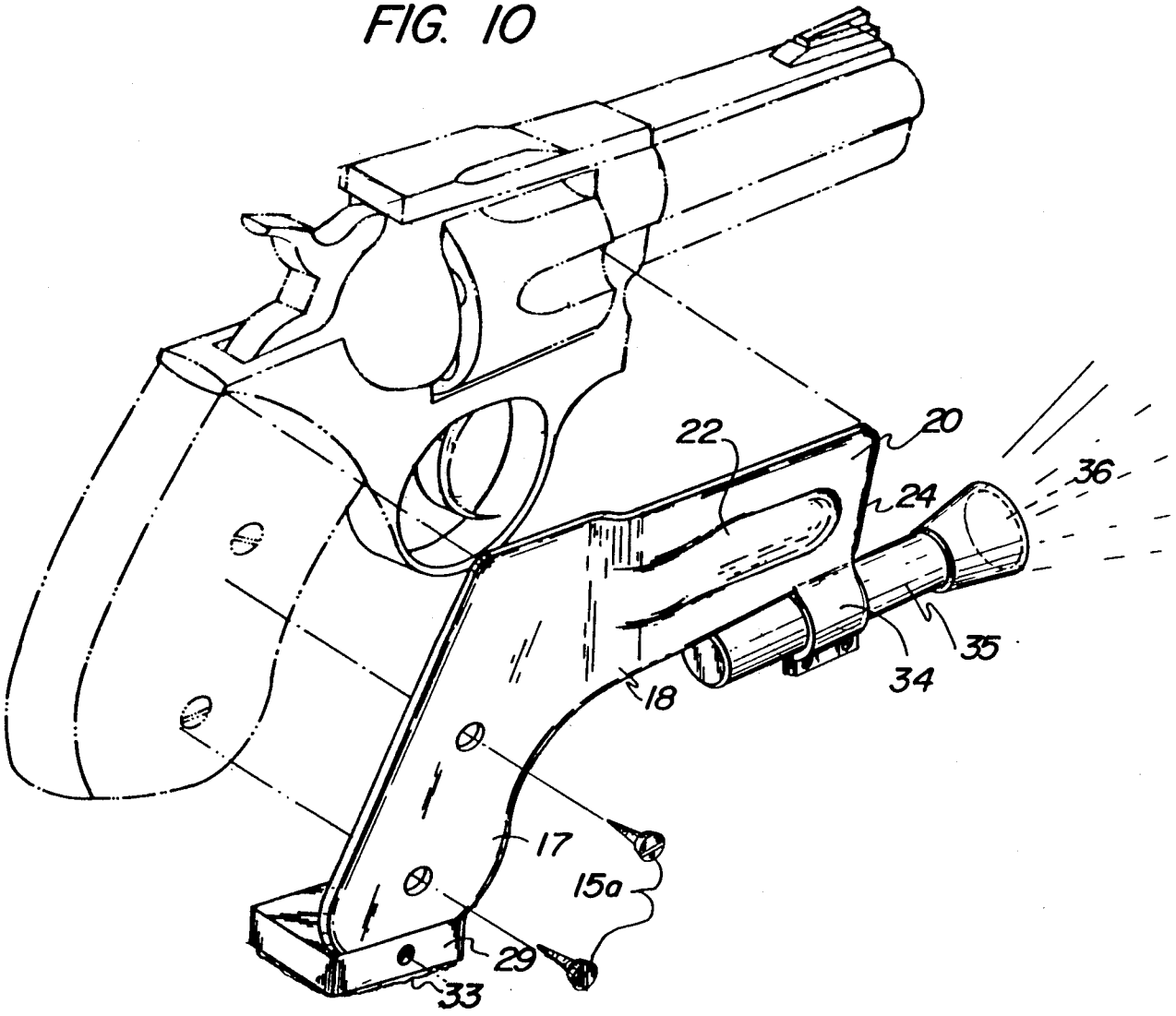
FIG. 10 is an isometric illustration of a further modification of invention.

The invention, as illustrated in FIG. 10, further includes a support ring 34 mounted to the second flange 20 to a bottom edge thereof adjacent the second flange forward terminal end 24 and flashlight housing 35 mounted within the ring, wherein the flashlight housing 35 includes a flashlight lens 36 that is orthogonally oriented relative to the second flange groove 22 to direct illumination towards a target for use in a practice sighting situation.

It should be noted that the first flange extension 18 includes a first flange extension projection 25, and wherein the second flange 20 includes a second flange projection 26 to effect contiguous communication between the first flange extension and the second flange relative to the pistol frame to provide for alignment relative to the pistol frame, wherein the first flange projection 25 and the second flange projection 26 may be formed of a compressible polymeric material to provide to form alignment of each projection relative to the pistol frame, wherein the first flange is mounted to the handle side wall 15. The projections are further arranged for extension orthogonally relative to an interior wall of the guide plate between the pistol frame and the respective first flange extension and the second flange respectively.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pistol grip apparatus in combination with a pistol assembly, wherein the pistol assembly includes a pistol handle, the pistol handle including a handle side wall, and said pistol assembly including a pistol frame mounting the pistol handle at a rear distal end of the pistol frame, and a pistol barrel mounted to the pistol frame at a forward distal end of the pistol frame, and a pistol cylinder assembly rotatably mounted within the pistol frame between the pistol barrel and the pistol handle, and a guide plate, the guide plate mounted to the pistol handle side wall and extending along the pistol frame, and including a groove, the groove oriented parallel relative to the pistol barrel, and the guide plate includes a first flange, wherein the first flange is complementarily, coextensively, and contiguously mounted to the handle side wall, and the first flange including a first flange extension plate, and the first flange extension plate extending beyond the handle adjacent the pistol frame between the pistol cylinder assembly and the pistol handle, and the first flange extension plate attached to a connecting web canted forwardly and above the first flange extension plate and a forward distal end of the connecting web including a second flange mounted thereto, wherein the first flange extension plate the connecting web, and the second flange are longitudinally aligned and define an obtuse included angle relative to the first flange, and the groove is directed into the second flange, and the groove including a groove entrance medially of the connecting web.

2. An apparatus as set forth in claim 1 wherein the first flange extension plate includes a first flange projection directed orthogonally relative to the first flange between the pistol frame and the first flange extension plate, and the second flange including a second flange projection orthogonally directed relative to the second flange positioned between the second flange and the pistol cylinder assembly.

3. An apparatus as set forth in claim 2 wherein the first flange projection and the second flange projection is formed of a compressible polymeric material.

4. An apparatus as set forth in claim 3 including a reservoir container mounted fixedly to a lower distal end of the first flange, wherein the reservoir container includes a reservoir container side wall, the reservoir container side wall is coplanar with the first flange, and the reservoir container is orthogonally mounted to the lower distal end of the first flange, and the side wall includes a fill bore, and a plug removably mounted relative to the fill bore, and the reservoir container includes a housing cavity within the reservoir container, and a chalk powder container within the reservoir container, and the reservoir container further including a bottom wall, the bottom wall including a fibrous dispensing mesh directed through the bottom wall into communication with the chalk powder.

5. An apparatus as set forth in claim 4 including a support ring fixedly mounted to a bottom edge of the second flange adjacent a forward terminal end of the second flange, wherein the support ring, the flashlight housing oriented parallel relative to the groove, and the flashlight housing including a flashlight lens arranged adjacent a forward distal end of the flashlight housing, wherein the flashlight lens is orthogonally oriented relative to the groove.

* * * * *